US005206621A

United States Patent [19]

Yerman

[11] Patent Number: 5,206,621

[45] Date of Patent: Apr. 27, 1993

[54] BARREL-WOUND CONDUCTIVE FILM TRANSFORMER

[75] Inventor: Alexander J. Yerman, Scotia, N.Y.

[73] Assignee: General Electric Company, Schenectady, N.Y.

[21] Appl. No.: 548,468

[22] Filed: Jul. 2, 1990

[51] Int. Cl.[5] ..... H01F 27/28

[52] U.S. Cl. ..... 336/180; 336/183; 336/200; 336/206; 336/223

[58] Field of Search ..... 336/200, 223, 206, 226, 336/225, 205, 180, 183

[56] References Cited

U.S. PATENT DOCUMENTS

| | | | |
|---|---|---|---|
| 3,102,245 | 8/1963 | Lawson, Jr. | 336/205 |
| 4,012,703 | 3/1977 | Chamberlayne | 336/200 |
| 4,755,783 | 7/1988 | Fleischer et al. | 336/223 |

FOREIGN PATENT DOCUMENTS

| | | | |
|---|---|---|---|
| 54-110424 | 8/1979 | Japan | 336/200 |
| 55-77117 | 6/1980 | Japan | 336/206 |
| 62-54905 | 3/1987 | Japan | 336/180 |
| 62-108511 | 5/1987 | Japan | 336/180 |
| 1021344 | 3/1966 | United Kingdom | 336/206 |

OTHER PUBLICATIONS

A. F. Goldberg and M. F. Schlecht, "The Relationship Between Size and Power Dissipation in a 1-10 MHz Transformer" from IEEE Applied Power Electronics Conf., 1989 pp. 625-634.

*Primary Examiner*—Thomas J. Kozma

*Attorney, Agent, or Firm*—Jill M. Breedlove; Marvin Snyder

[57] ABSTRACT

A transformer having a barrel winding comprised of flat conductive film conductors is provided with a repeatable winding configuration by employing a dielectric metal laminate as the winding material and by patterning both primary and secondary windings on the same dielectric membrane, thereby fixing the relative positions of the primary winding and secondary winding terminals and conductors.

30 Claims, 11 Drawing Sheets

Fig. 1
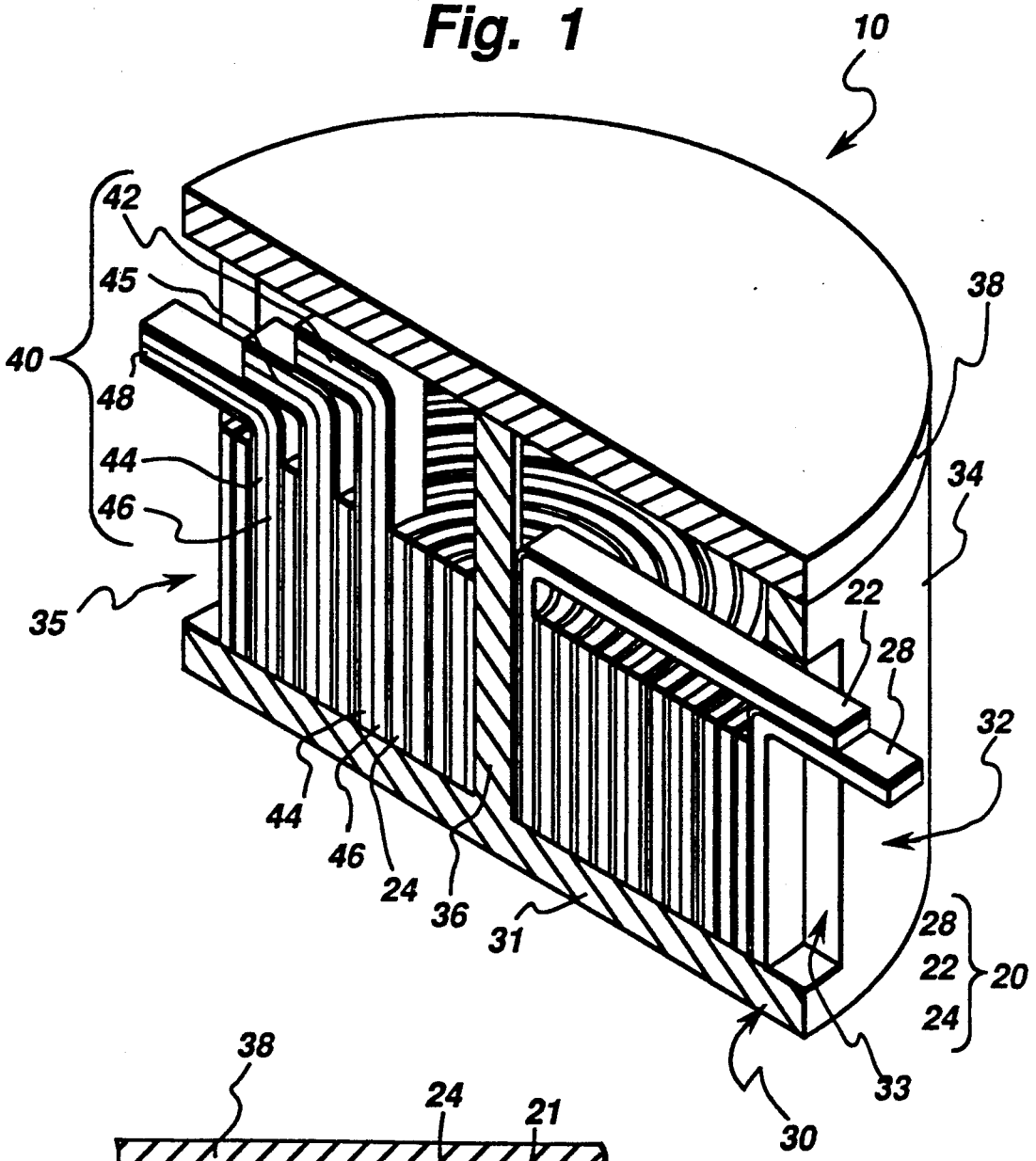
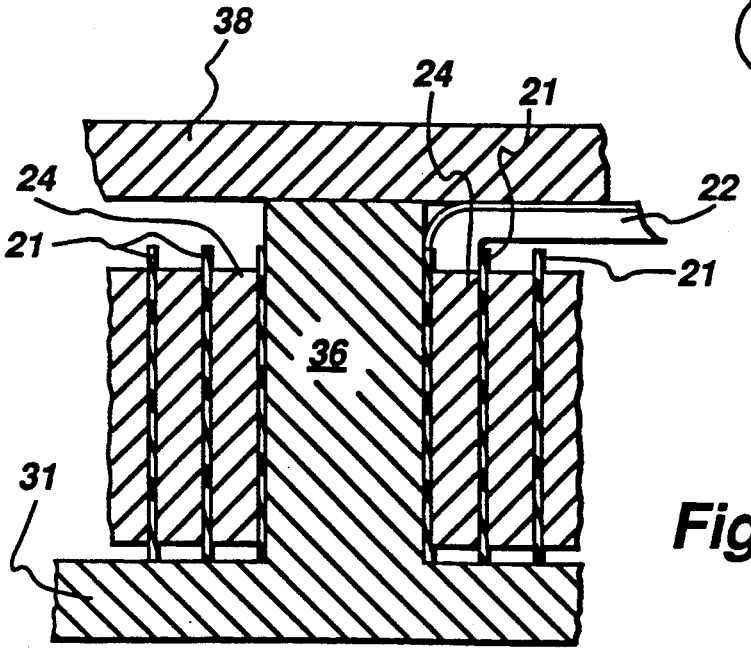
Fig. 1A 46
45
40
44
21
24
20
22

45
46
44
21
24
22

46
44
49
21
45
24
22

STACKING ARRANGEMENT FOR 8:1:1 TRANSFORMER

| TURN No. | 1/2 TURN | | 2/2 TURN | | LAYER No. |
|---|---|---|---|---|---|
| 0 | P1 | (24) | P1 | (24) | 1 |
| 1 | P2 | (24) | P2 | (24) | 2 |
| 2 | P3 | (24) | P3 | (24) | 3 |
| 3 | P4 | (24) | P4 | (24) | 4 |
| 4 | P5 | (24) | SA1 | (46A) | 5 |
| 5 | SA1 | (46A) | SB1 | (44A) | 6 |
| 6 | SB1 | (44A) | P5 | (24) | 7 |
| 7 | P6 | (24) | SA2 | (46B) | 8 |
| 8 | SA2 | (46B) | SB2 | (44B) | 9 |
| 9 | SB2 | (44B) | P6 | (24) | 10 |
| 10 | P7 | (24) | P7 | (24) | 11 |
| 11 | P8 | (24) | P8 | (24) | 12 |

WHERE: Pn IS PRIMARY TURN No.
SAn IS SECONDARY A TURN No.
SBn IS SECONDARY B TURN No.

*Fig. 6*

BARREL-WOUND CONDUCTIVE FILM TRANSFORMER

RELATED APPLICATIONS

The present application is related to application Ser. No. 07/359,063, filed May 30, 1989, entitled "Conductive Film Magnetic Components" by A. J. Yerman et al., now U.S. Pat. No. 5,017,902, issued May 21, 1991; application Ser. No. 07/390,036, filed Aug. 7, 1989, entitled "High Frequency Transformer" by A. J. Yerman et al., now U.S. Pat. No. 4,959,630, issued Sep. 25, 1990; and application Ser. No. 07/548,461, filed Jul. 2, 1990, entitled "Low-Profile Multi-Pole Conductive Film Transformer" by A. J. Yerman, now U.S. Pat. No. 5,126715, issued Jun. 30, 1992, each of which is incorporated herein by reference in its entirety.

FIELD OF THE INVENTION

The present invention relates to the field of magnetic components, and more particularly, to the field of conductive film transformers.

BACKGROUND INFORMATION

The related "Conductive Film Magnetic Components" patent application discloses magnetic components having windings comprised of a continuous flat conductive film which has a serpentine configuration when disposed in a plane and which is folded upon itself to form a plurality of layers providing a current path which encircles a magnetic pole of the structure. Also disclosed therein are secondary windings interleaved with the layers of the continuous film winding to provide a transformer. The conductive film secondary windings may comprise a plurality of separate conductive films connected in parallel to provide a low resistance, high current capacity secondary winding. Such structures are particularly useful for step down transformers because they provide primary and secondary windings having substantially equal power handling capacities at high frequencies.

The related "High Frequency Transformer" patent application discloses a flat conductive film transformer in which the primary and secondary windings are disposed on a common dielectric membrane.

A recognized alternative winding configuration for flat conductor windings for use in high frequency transformers is the barrel-wound transformer winding in which flat conductors are wound around a mandrel and then placed over a central post in a cylindrical ferrite cup core. As discussed at pages 625 and 626 of an article entitled "The Relationship Between Size and Power Dissipation in a 1-10 MHz Transformer" by A. F. Goldberg et al. which appeared in the proceedings of the 1989 IEEE Applied Power Electronics Conference at pages 625-634, barrel-wound transformers present size and power density complications and/or winding connection complications because of the manner of winding the windings to form a cylinder for insertion in the ferrite cup core.

One of the problems with barrel-wound transformers is interconnecting different turns of a multi-turn, multilayer winding. For economy and speed of assembly, it is desirable to use commercially available cup cores for these transformers. Such cup cores have diametrically opposed slots in their sidewalls for passage of the primary and secondary winding external terminal portions. A problem with existing barrel-would transformers is that the primary and secondary winding external terminal portions are frequently offset from diametrically opposed positions following winding of those conductors on a mandrel during the fabrication of the transformer.

The above-identified related patent applications present solutions to the problems of efficiently connecting different layers of planar transformer windings. There is a need for a corresponding improvement in the interconnection of windings in a barrel-wound flat conductor transformer.

OBJECTS OF THE INVENTION

Accordingly, a primary object of the present invention is to provide an improved primary winding conductor/secondary winding conductor configuration which facilitates the fabrication of efficient, small barrel-wound transformers.

Another object of the present invention is to provide a technique for forming primary and secondary windings of a flat conductor barrel-wound transformer in a manner which ensures proper relative positioning of the external terminals of the different windings.

Another object of the present invention is to provide primary and secondary winding external terminal portions which have predefined, easily repeatable relative positions in their as-barrel-wound configurations to facilitate insertion in a cup core.

Another object of the present invention is providing secondary winding designs with greater copper cross-section and reduced resistance from single layer copper-Kapton laminates of constant copper thickness.

SUMMARY OF THE INVENTION

The above and other objects which will become apparent from the specification as a whole, including the drawings, are accomplished in accordance with the present invention by providing the primary winding and secondary winding conductors of a flat conductor barrel-wound transformer on a common dielectric membrane. A preferred starting material for the winding is a sheet of Kapton-copper flex-circuit laminate. The primary and secondary winding conductive films are preferably patterned in a photolithographic masking and etching operation, thereby ensuring their desired relative positions. The length and relative positions of these conductive films are established in accordance with the overall winding lengths, the thicknesses of the dielectric membrane and the conductive films, the size of the mandrel on which the membrane is to be wound to form the barrel-wound winding and the desired relative positions of the external terminal portions of the two conductive films. Two terminal and multi-terminal (tapped) windings may be provided in this manner. Either winding may comprise a plurality of distinct conductive film segments connected in parallel to reduce winding resistance and increase the winding's current and power handling capacity.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

FIG. 1 is a perspective, cut away illustration of a barrel-wound transformer in accordance with the present invention;

FIG. 1A is a detail of FIG. 1;

FIG. 6 is a table of the winding turn positions in FIG. 5;

DETAILED DESCRIPTION

Figure 2:
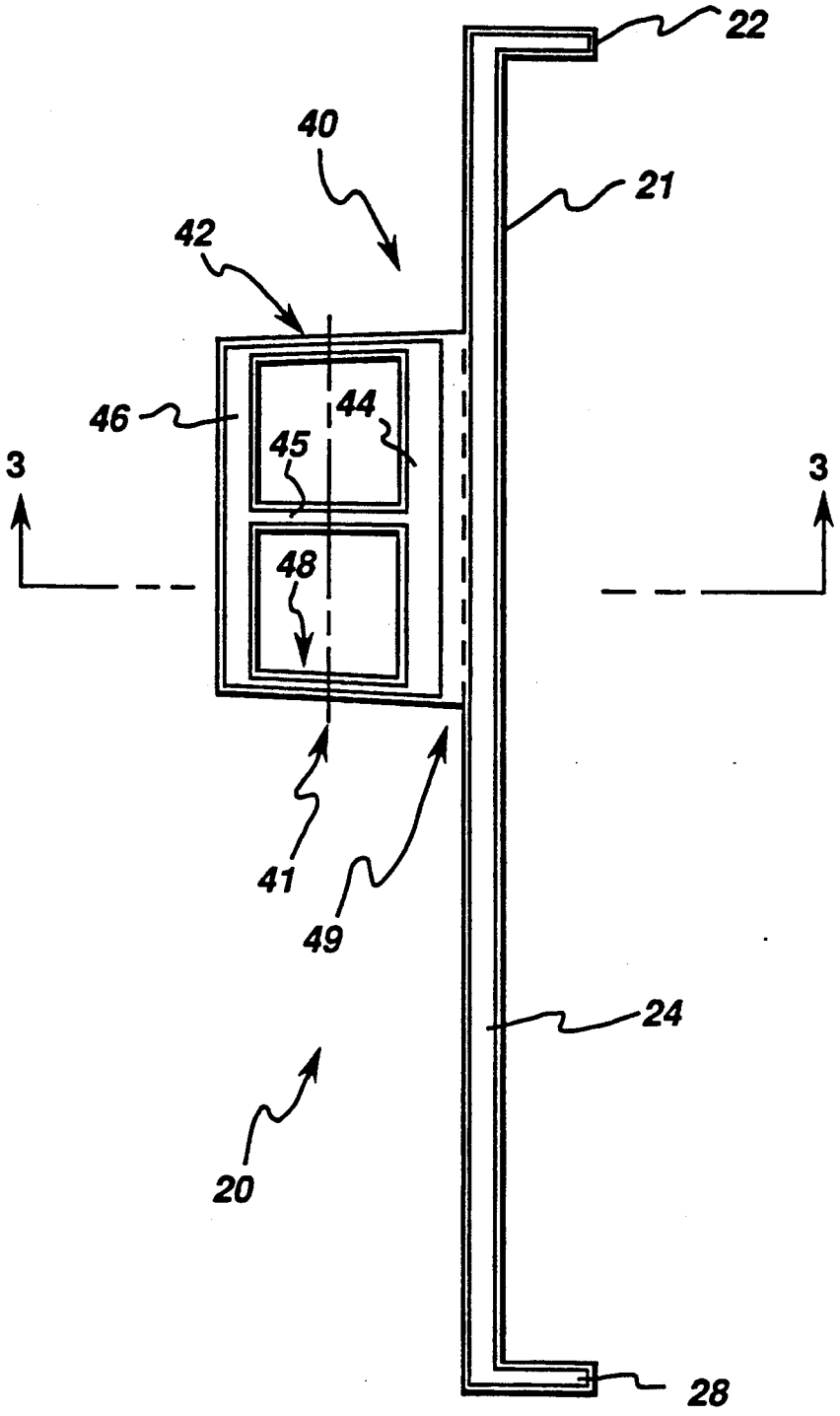
FIG. 2 is a plan view illustration of the windings of the transformer in FIG. 1 prior to folding and wrapping.

FIG. 1 is a perspective, cut-away illustration of a barrel-winding transformer 10 in accordance with the present invention. The transformer 10 comprises a cup core 30 having a bottom or cup portion 32 with bottom wall 31, an integral exterior wall 34 and central post 36 and a separate cap portion 38. The wall 34 has two gaps 33 and 35 therein to facilitate bringing the external terminal portions of its primary winding 20 and its secondary winding 40 outside the cup core. The two terminal portions 22 and 28 of the primary winding 20 extend through the gap 33 while the three terminal portions 42, 45 and 48 of the secondary winding extend through the gap 35. It will be noted in the illustration that each of the winding conductors 24, 44 and 46 extends essentially the full height of the interior cavity of the cup core. Instead of the single cup core and cap plate configuration illustrated, two cup cores placed open end to open end may be used to accommodate a winding which is twice as high and therefore capable of carrying twice as much current. All of the conductors of both the primary winding 20 and the secondary winding 40 are disposed on a common dielectric membrane 21 which includes a portion which projects vertically above and below the conductors of these winding to help prevent electrical shorts between the primary and secondary windings. That projecting portion is omitted in FIG. 1 in the interest of drawing clarity, but is illustrated in a detailed view in FIG. 1A in the vicinity of the central post 36 of the cup core 30.

FIG. 2 is a plan view illustration of the primary winding 20 and the secondary winding 40 disposed on dielectric membrane 21 prior to folding membrane 21 and wrapping the windings on a mandrel for insertion in the cup core 30. The windings 20 and 40 are disposed on a common dielectric membrane 21 which may preferably be KAPTON® polyimide film available from E. I. DuPont de Nemours to which a copper foil has been laminated in a manner well known in the flex circuit laminate art. The copper foil has subsequently been patterned using photoresist in combination with photolithographic exposure through an appropriate mask to define the areas of copper to be retained in the final structure. This is preferably done by first patterning the copper and then etching it away only where the Kapton is to be removed. An $O_2$-freon plasma is then used to etch away the exposed Kapton. Then a second patterning/etching operation defines the final copper shape so that it is ~0.010" inside the Kapton shape. This gives some extra dielectric surface at the edges to prevent breakdown as shown in detail in FIG. 1A.

As an alternative to the plasma etching step to define the boundaries of the Kapton layer, the winding configuration may be die stamped after the copper etch which defines the copper boundaries. This process is less precise than the all etching fabrication process, but eliminates the need for the plasma etching of the Kapton and thus is less expensive.

The primary winding 20 comprises a main winding conductor 24 having first and second external terminal portions 22 and 28, respectively, which extend substantially perpendicular to the length of the conductor strip 24.

The secondary winding 40 has a generally numeral "8" configuration and comprises two main winding conductor strips 44 and 46 which correspond to the vertical sides of the numeral 8. During the fabrication process, the copper pattern of the secondary winding 40 is folded along the vertical center line of the numeral 8 to form a structure having the general appearance of a backward capital "E". The horizontal members of the letter "E" comprise the three external terminal portions 42, 45 and 48 of the secondary winding 40.

Figures 3A, 3B, 3C, 3D:
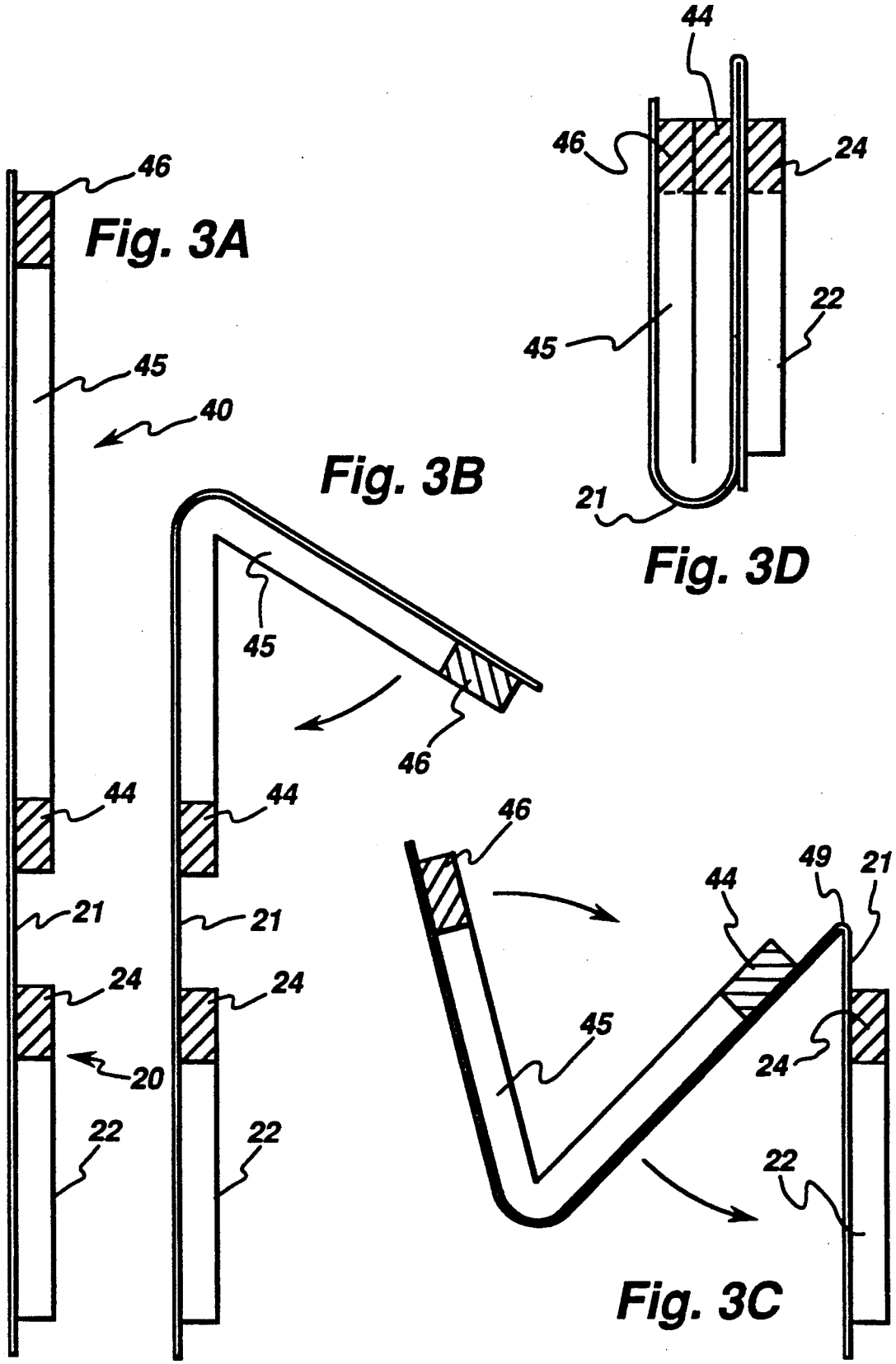
FIGS. 3A-3D illustrate a sequence of steps in folding the windings of FIG. 2 in preparation for winding them on a mandrel.

In FIGS. 3A-3D, the windings 20 and 40 are shown in cross-section in stages in the process of being folded. The cross-section is taken along the line 3—3 in FIG. 2. In FIGS. 3A, the winding is still flat. First, the numeral 8 of the secondary winding is folded along its vertical center line to form a generally book-like structure as shown in FIG. 3B in which the winding strips 44 and 46 comprise the edges of the cover and the folds in the external terminal portions 42, 45 and 48 correspond to the binding of the book. This initial fold is performed along the vertical center line 41 of the numeral 8 (FIG. 2). In FIG. 3C, the beginning of folding the Kapton layer 21 along a second fold line 49 disposed between the primary winding main conductor 24 and the secondary winding conductor 44 is shown. In FIG. 3D, the winding is shown in cross-section in its fully folded configuration.

Figure 4:
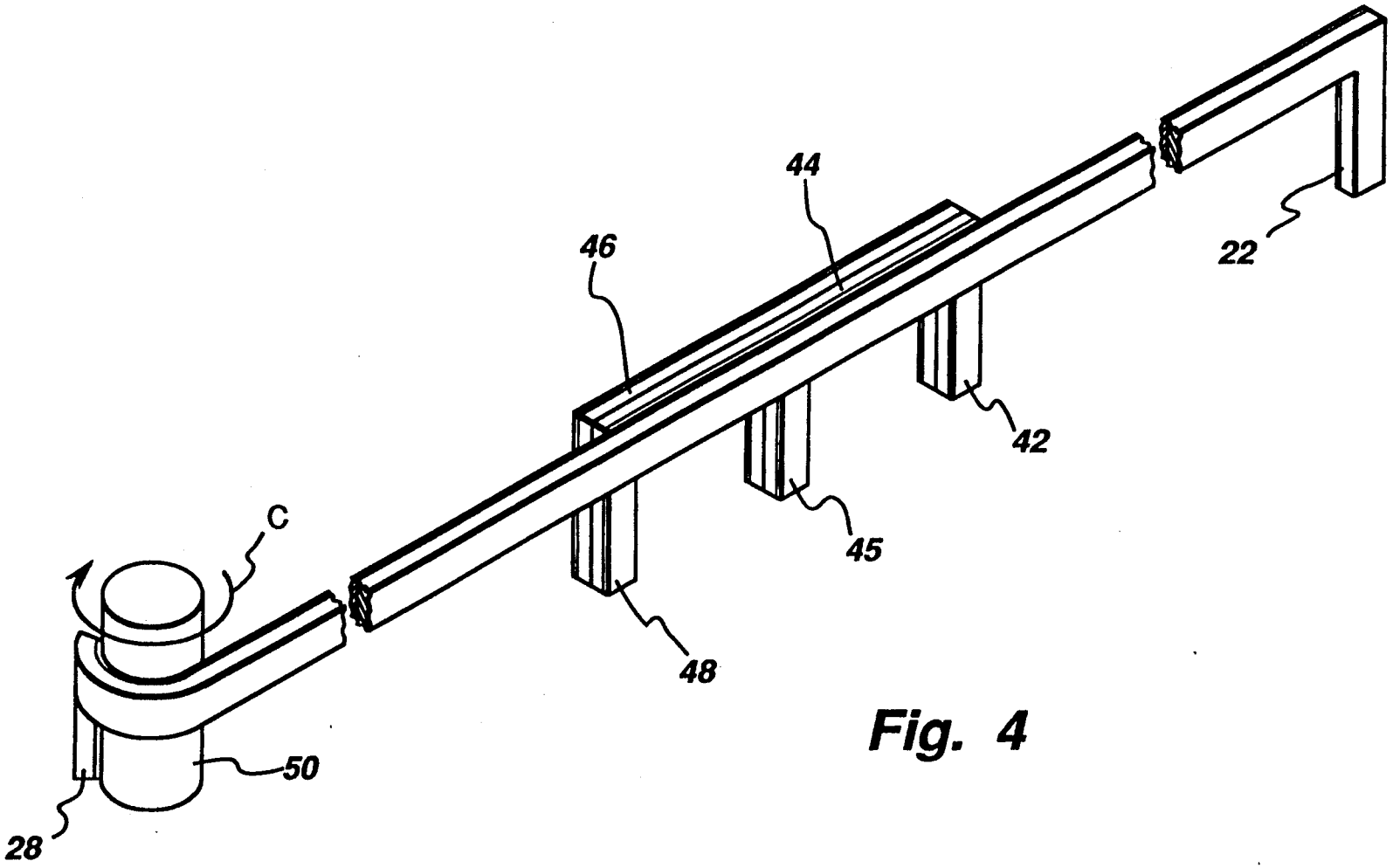
FIG. 4 illustrates the windings of FIG. 3 in their fully folded configuration at the start of the process of winding them on a mandrel.

The windings 20 and 40 are illustrated in perspective view in their completely folded configuration in FIG. 4 ready for wrapping on the mandrel 50. It will be noted in FIG. 4 that along the portion of the primary winding conductor 24 where the secondary winding is disposed, the secondary winding conductor 44 is disposed adjacent the primary winding conductor 24 with the secondary winding conductor 46 spaced from the primary winding conductor 24 by the conductor 44. It will be understood that the sides of the conductor strip 44 and 46 which face each other are preferably free of dielectric material so long as the intended operating frequency of the transformer is not so high that the skin effect will restrict the effective conductive volume of the copper strips 44 and 46 and the external terminal portions 42, 45 and 48. The conductor strips 44 and 46 are insulated from the adjacent primary winding conductor 24 by the dielectric insulation along both exterior surfaces of the letter "E".

Figure 5A:
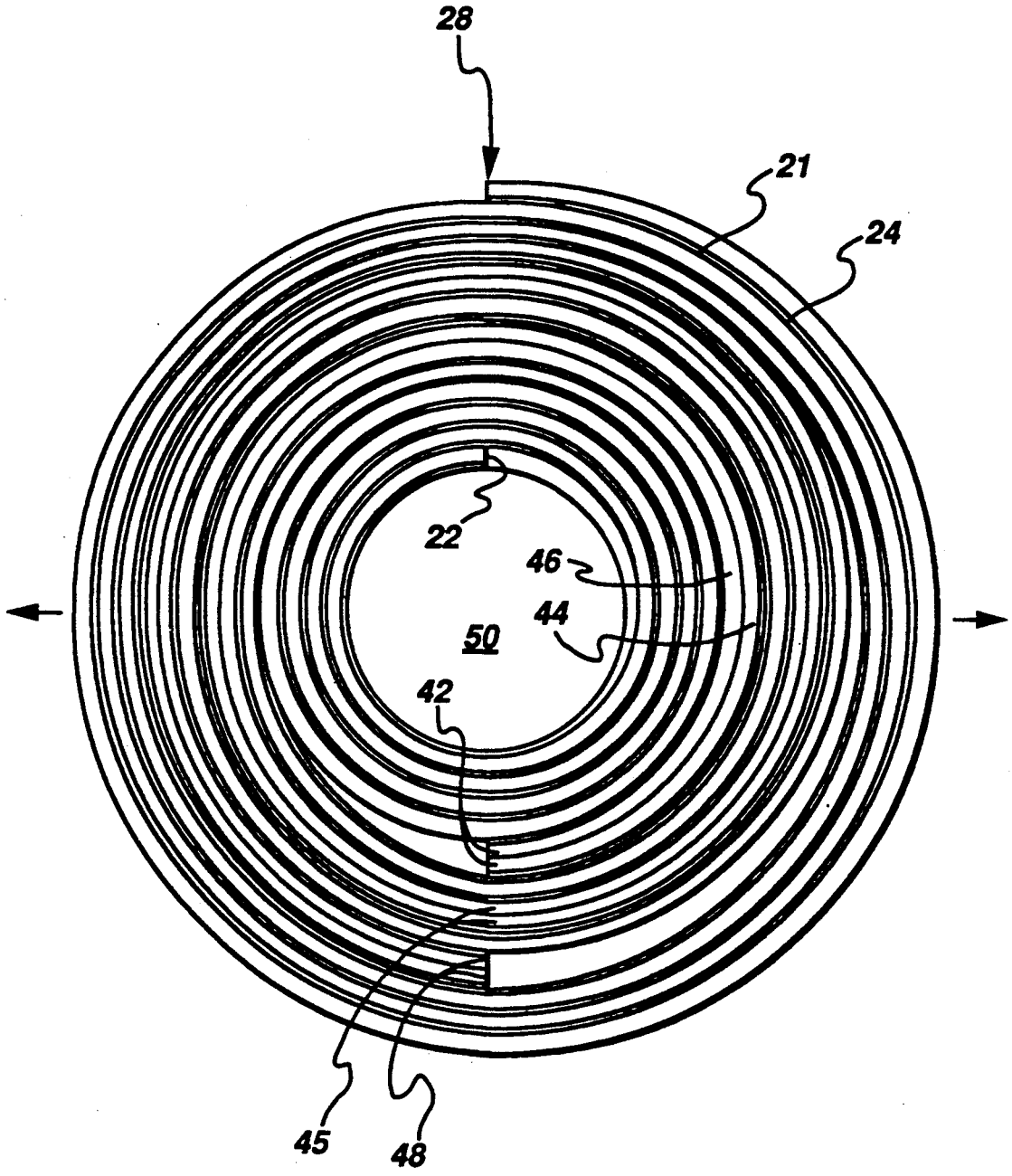
FIG. 5A illustrates the windings of FIG. 4 in a top view relative to FIG. 4 after wrapping on a mandrel in preparation for insertion in the cup core of FIG. 1.
Figure 5B:
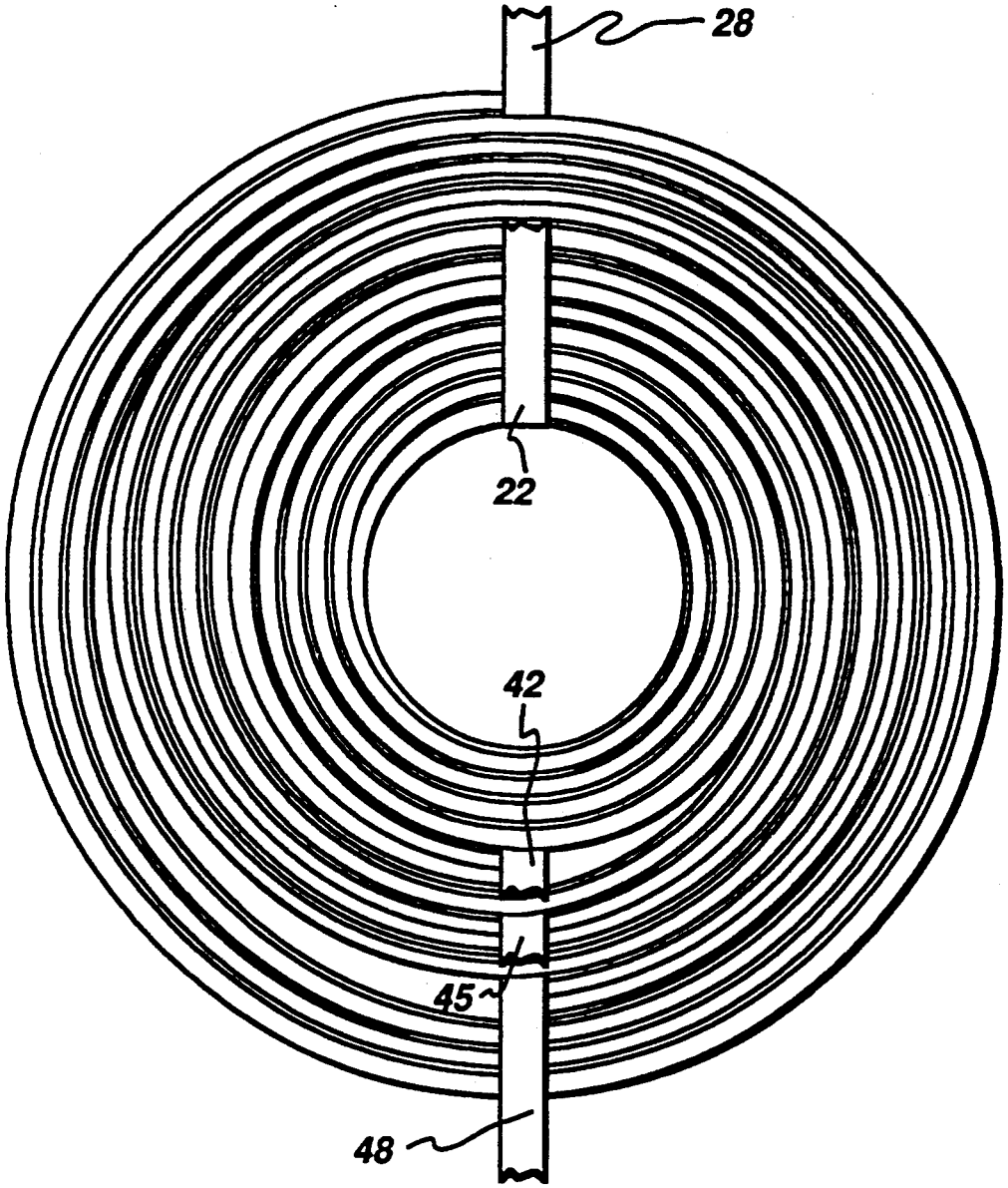
FIG. 5B illustrates the windings of FIG. 4 in a bottom view relative to FIG. 4 after wrapping on the mandrel and after folding the external terminal tabs down in preparation for insertion in the cup core.

In FIG. 5A, the windings 20 and 40 are illustrated in a top plan view (relative to the FIG. 4 view) after wrapping around the mandrel 50 in preparation for insertion in the cup core 30 of FIG. 1. In FIG. 5B, the winding is shown in a bottom plan view (relative to the FIG. 4 view) after the external connection tabs have been bent down in preparation for insertion in the cup core. (This is a top plane view relative to FIG. 1). As indicated by the arrow labeled C in FIG. 4, the winding 20 has been wrapped with the toward-the-viewer surface of the conductor 24 away from the cylindrical surface of the mandrel 50. As indicated in the table in FIG. 6 and as may be observed from study of FIG. 5A, working from the inside of the spiral of windings outward, the first nine half turns of winding are primary winding conductor 24. At that point, the two secondary winding conductors 46 and 44 are included in the winding pattern whereby the next two full turns of the winding are the secondary winding conductors 46 and 44. The next two half turns are again the primary winding conductor 24, followed again by the two secondary winding conductors 46 and 44, all followed by five half turns of the primary winding conductor 24. The winding designations in the table in FIG. 6 employ a P to represent the primary winding and the letters SA1 and SA2 to indicate the inner and outer conductors of the first secondary winding turn "A" and the letters SB1 and SB2 to indicate the inner and outer conductors of the second secondary winding turn "B". The numbers following the letters indicate the layer of the corresponding winding which is in that location. The conductors identified in the table as being first-half-turn conductors are encountered in sequence from the mandrel 50 outward along the arrow extending to the left in FIG. 5 and the conductors identified as second-half-turn conductors are 5.

It will be observed from the FIG. 5 configuration that each half turn of the primary winding is longer than the preceding half turn with the length of the conductor 24 present in the innermost half turn of the winding 20 being substantially shorter than the segment of the conductor 24 disposed in the outermost half turn of the winding 20. The same thing is true with the secondary winding conductors 46 and 44. For a Kapton dielectric membrane of a fixed thickness and for a copper foil of fixed thickness, the length of each half turn segment of each of the windings is repeatable from one transformer to another so long as the windings are tightly wrapped on the same diameter mandrel in the process of wrapping the windings in preparation for inserting them in the ferrite cup core. For insertion in commercially available ferrite cup cores which have diametrically opposed slots 33 and 35 for the primary and secondary winding external terminal portions, it is important that the secondary winding external terminal tabs line up with each other and be diametrically opposed to the external terminal portions of the primary winding which must also line up among themselves. Consequently, proper design of the basic winding configuration illustrated in FIG. 2 requires taking into account the diameter of the mandrel 50 and the thicknesses of the dielectric membrane and the conductors of the windings. With proper accounting for these characteristics of the structure, the runout from winding half turn to winding half turn for the conductors 24, 46 and 44 can be analytically determined and provided for in the layout of both the primary winding 20 and the secondary winding 40 to ensure the desired alignment among the external terminal portions 42, 45 and 48 of the secondary winding 40 and the separate desired alignment between the external terminal portions 22 and 28 of the primary winding 20 and the desired relation between the external terminal portions of the primary and secondary windings. That is, that the external terminal portions of the secondary winding will be disposed diametrically opposed to the external terminal portions of the primary winding, which facilitates insertion of the barrel-wound winding structure in the cup core 30. Thus, proper layout of the winding conductor patterns ensures straightforward, error-free wrapping of the barrel-wound windings in a manner which facilitates the inexpensive fabrication of transformers in accordance with the present invention.

Figure 7:
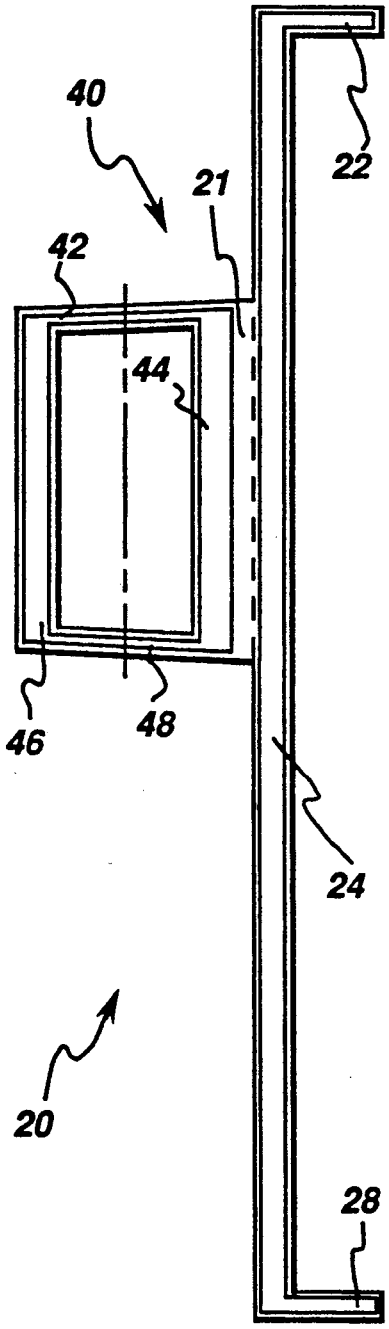
FIG. 7 is a plan view illustration similar to FIG. 4 of an alternative winding configuration in which the secondary winding is untapped.

In FIG. 7, an alternative winding configuration is illustrated in a plan view similar to the FIG. 2 plan view. The winding configuration illustrated in FIG. 7 is similar to the winding configuration illustrated in FIG. 2 with the exception that the secondary winding 40' has the general configuration of a rectangular numeral 0 rather than a numeral 8 because of the omission of the central cross bar 45 of the numeral 8. This winding is fabricated, folded and wound in the same manner as the winding of FIG. 2, but provides only first and second external terminal portions 42 and 48 for the secondary winding 40' with the result that the secondary winding is not center tapped and can be used to provide one, two or more secondary turns, depending on the height of the numeral 0.

Figure 8:
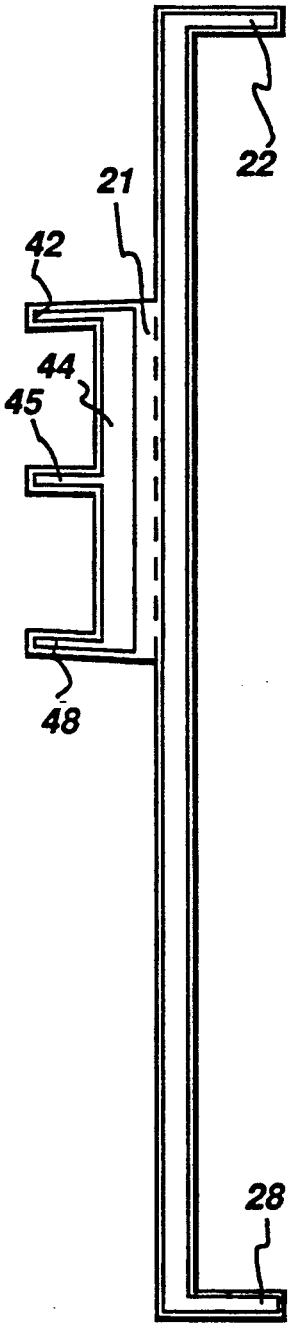
FIGS. 8-13 illustrate further alternative winding configurations.
Figure 9:
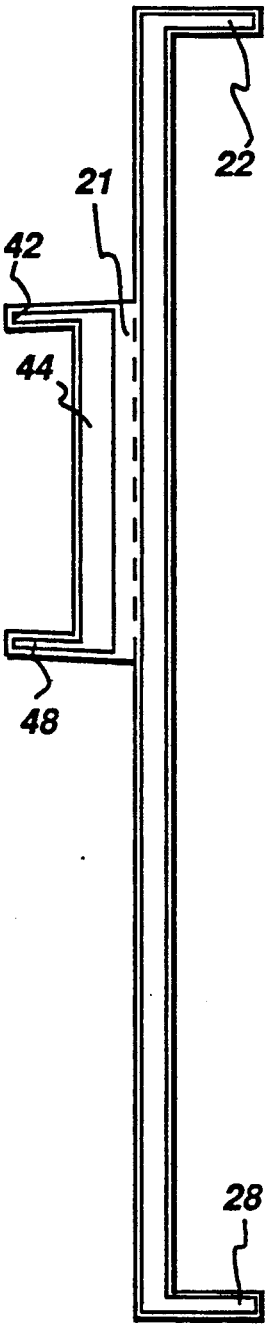

While in the figures the secondary winding in each case forms a closed configuration, it will be understood that the portion of the numeral 8 or the numeral 0 to the left of the vertical center line thereof may be omitted to thereby provide secondary winding conductor configurations resembling a backwards E and a backwards C, as shown in FIGS. 8 and 9, respectively. In that configuration, the secondary winding has only a single winding conductor 44 rather than the two winding conductors 44 and 46, provided by the FIG. 2 and FIG. 7 winding conductor patterns. Such designs are useful where a single layer of copper in the secondary provides adequately low resistance or reduced power handling capacity is required.

Figure 10:
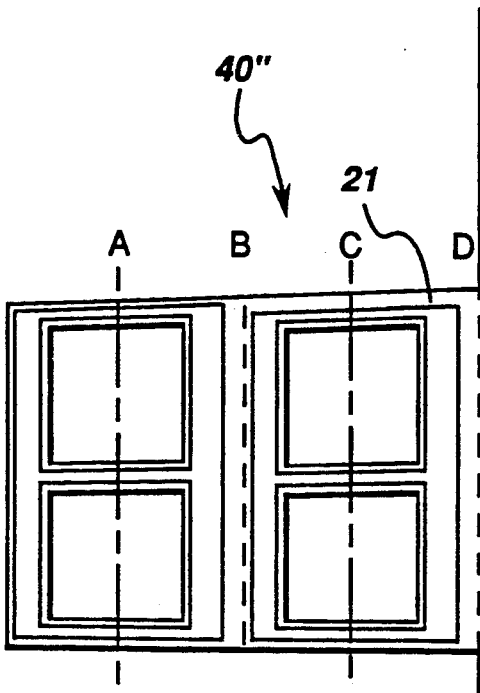

Additional conductors in the primary winding and secondary windings may be provided by using a polyimide membrane having copper laminated on both sides and providing appropriate copper patterns on the opposing sides of the membrane. Additional parallel turns of the secondary winding 40 may be provided by modifying the winding structure of FIG. 2 as illustrated in FIG. 10 where the secondary winding 40'' has a generally double numeral 8 configuration in which the conductors of the winding 40'' are folded along four fold lines A–D rather than two fold lines in order to provide the generally "E" winding configuration illustrated in FIG. 3.

Figure 11:
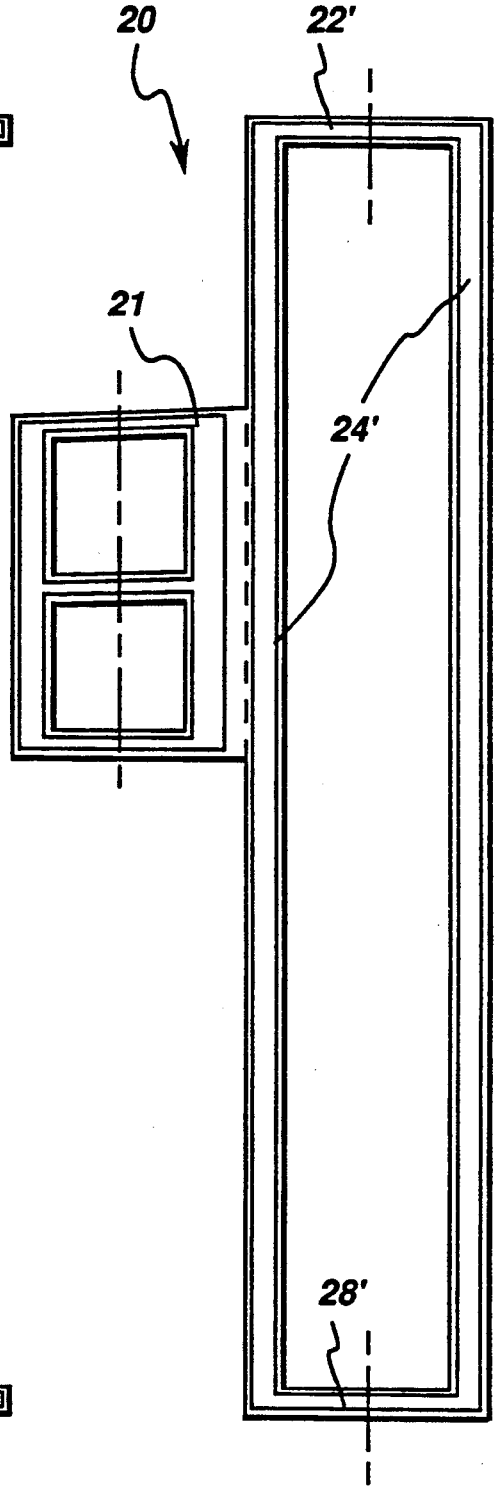

If desired, the primary winding conductor may be initially configured in a rectangular numeral zero configuration as shown in FIG. 11 at 20' and folded along its vertical center line to double the number of primary winding conductors in a manner similar to that used with the secondary windings 40 and 40'. It will be apparent that these alternative configurations result in a larger diameter overall barrel winding configuration than would be produced for the same number of winding turns with fewer parallel conductors. The number of parallel conductors can be increased to any desired number by extension of this winding conductor configuration modification and folding.

Figure 12:
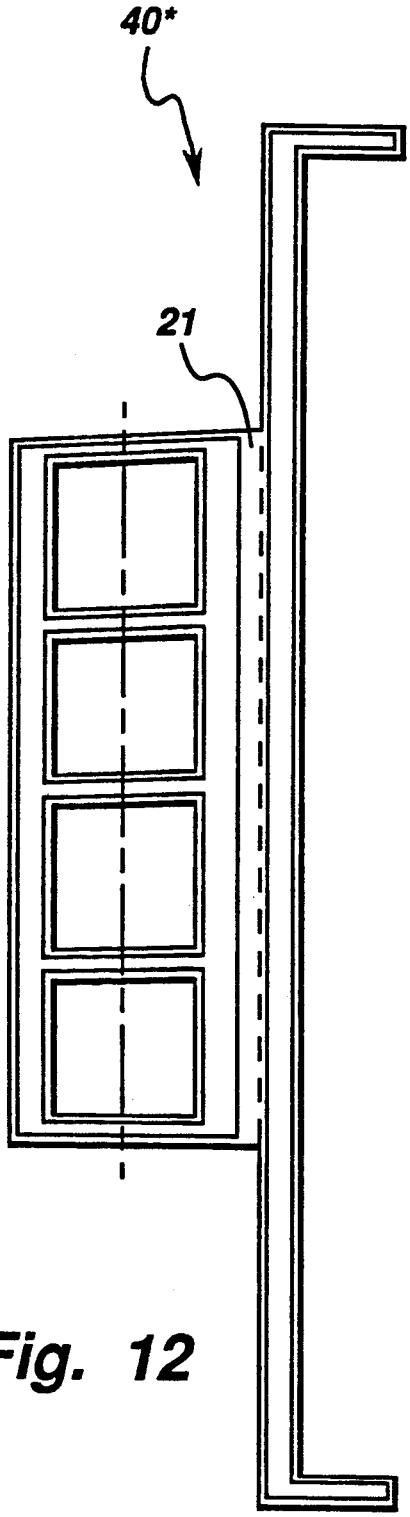

If desired, additional turns of the secondary winding may be provided by lengthening the conductors 44 and 46 in any of the winding configurations. Also, stacked numeral 8's. as shown in FIG. 12 at 40* or stacked numeral 0's may be used to provide additional secondary winding turns. These additional secondary winding turns may be connected in series with the initial winding turns to provide a greater voltage output or connected in parallel with the initial secondary winding turns to provide greater current carrying capacity at the same voltage level.

It will be noted that maximum copper winding conductor area is provided in this barrel-wound transformer by the use of full height conductor strips in the barrel winding which substantially fill the cavity of the ferrite cup core. By utilizing two cup cores stacked open-end-to-open-end to enclose the winding, the winding height can be doubled to provide twice the current handling capacity. If desired, a larger number of half-height conductor members could be employed by dividing the conductor strips 24, 44 or 46 into separate subportions. However, this is not preferred because it complicates winding fabrication and wrapping and provides no significant benefit unless the parallel conductors are connected in series which requires additional external terminal portions on the conductive films.

Figure 13:
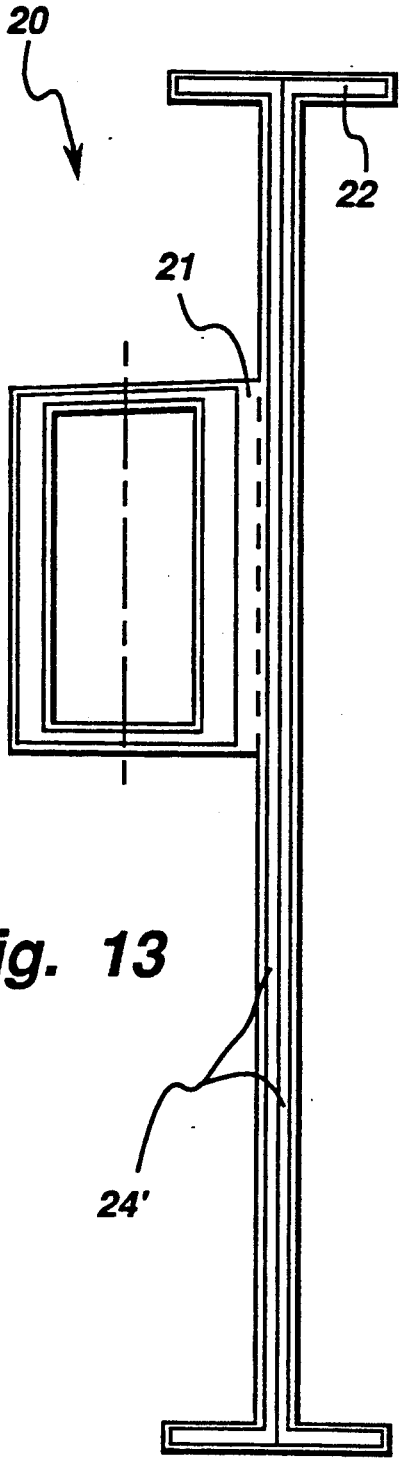

As illustrated in plan view in FIG. 13, the primary winding 20 may be provided with external terminal portions extending to both sides of its main conductor strip 24. This has no significant advantage in the winding configuration illustrated in FIGS. 2 and 7. However, if the conductor strip 24 is divided in half along its length to provide two parallel conductors 24' which can be folded along line A—A to provide twice the primary copper thickness, or a second set of external terminal portions to provide a means for separately bringing the two conductor strips 24' out to external terminals. This facilitates the connection of the two conductor strips 24' in series, if desired, to provide a high turns ratio in the same number of winding layers.

One potential problem in fabricating barrel transformers of this type which have relatively long primary windings is facility limitations on the size of structures which can be handled as a single piece. In particular, where plasma etching is used to pattern the Kapton polyimide film, severe restrictions may be result. In particular, many plasma etching machines are only capable of handling a piece having a maximum length of 24 inches. For a turns ratio of 10:1 or so, 24 inches may not be a sufficient length for the primary winding. Under these conditions, one alternative is to fabricate the primary winding as two separate copper Kapton laminates and then solder the two pieces of the main primary winding together to form a single, continuous winding. This procedure has a number of drawbacks. First, for the winding to wind properly, the two portions of the primary winding must be accurately aligned during soldering so that they can be wrapped on the mandrel in an appropriate fashion. Second, the splice where the two pieces are soldered together is stiffer than the remainder of the winding and can create problems in winding the winding on the mandrel. A particular problem with this aspect is the fact that the stiffness of the splice may vary from winding to winding, thus creating non-identical winding structures.

Figure 14:
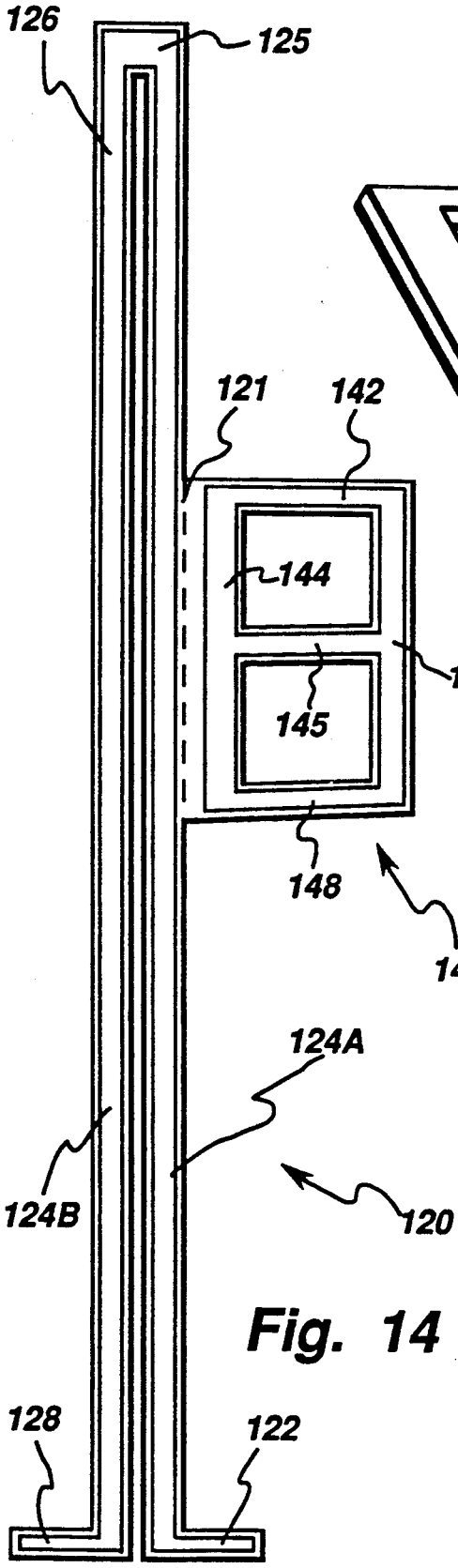
FIG. 14 illustrates an alternative flat pattern for a long primary winding.

An alternative primary winding configuration which overcomes this problem is illustrated in FIG. 14 where a primary winding 120 is illustrated along with a secondary winding 140 both of which are disposed on a common dielectric membrane 21. The primary winding 120 comprises a first connection tab 122, a first long primary winding conductor 124A, a second long primary winding conductor 124B, a second external connection tab 128 and a connection or joint 125 which connects the two long winding conductors 124A and 124B together at their ends remote from the connection tabs 122 and 128. The connection portion 125 is part of the same copper film or foil as the long conductors 124A and 124B such that the primary winding 120 is a single continuous copper foil which extends from the end of connection tab 122 to the far end of connection tab 128. In FIG. 14, the point on the conductor 124B where the connector 125 stops is identified by the reference numeral 126 which will be referred to in connection with the folding of this winding system.

Figure 15:
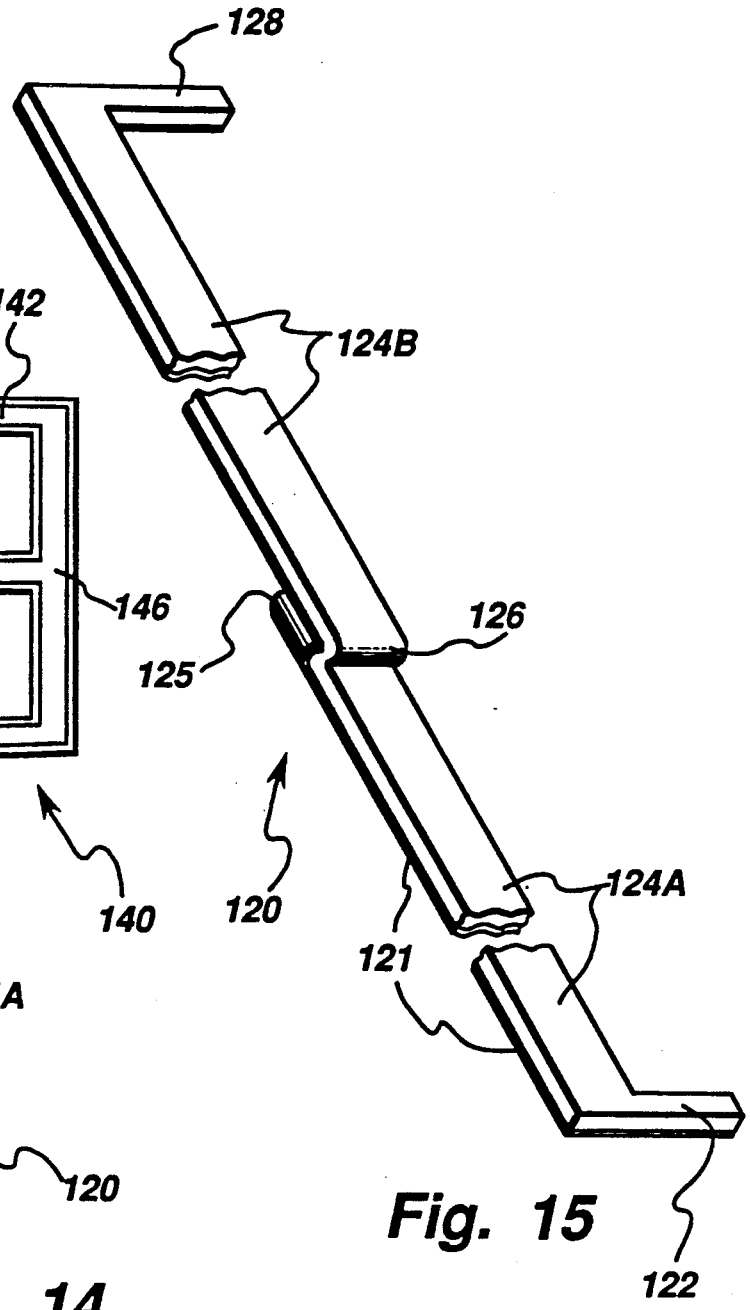
FIG. 15 illustrates the conductor of FIG. 14 after preliminary folding in preparation for winding on a mandrel.

In FIG. 15, the primary winding 120 is shown in a folded configuration ready for winding on a mandrel. In FIG. 15, the secondary winding 140 is omitted from the drawing and may be thought of as being located within the gap or break in the conductor 124A. The winding of FIG. 14 is converted to the FIG. 15 configuration by initially folding the winding layer 124B over on top of the winding conductor 124A so that the connection tab 128 is disposed directly on top of connection tab 122 and the connector or bridge portion 125 of the copper foil becomes a fold, as illustrated along the left-hand edge of the strip 124A at its end remote from the connection tab 122. With the winding conductor in that initially folded configuration, the conductor 124B is subsequently folded back on itself at the point 126 to form the fold identified in FIG. 15 at the reference numeral 126. In this manner, a splice-free primary winding which is substantially twice as long as the maximum length piece the system can process, may be provided. While the winding 120 is slightly thicker in the vicinity of the folds 125 and 126 than it is elsewhere and is also slightly stiffer in that location, the copper foil is of uniform thickness and width throughout the entire length of the winding. Further, this fold configuration is highly repeatable.

It will be recognized that still longer windings may be provided by beginning with a foil configuration having additional long conductor strips similar to strips 124A and 124B and more bridge portions 125 connecting adjacent strips at one end to form an initial serpentine pattern for the copper foil of the primary winding. In that situation, the connection tab 128 is placed at the end of the conductor strips remote from the connection tab 122. If desired, the primary and secondary windings may be provided on the opposite surfaces of a double-sided copper/Kapton laminate.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. In a transformer, the improvement wherein the windings comprise:

a dielectric membrane having first and second major surfaces;

an elongated, continuous primary winding conductive film disposed on one of the major surfaces of said dielectric membrane, said primary conductive film having first and second terminal poritons extending at an angle therefrom at respective ends thereof;

a secondary winding conductive film on one of the major surfaces of said dielectric membrane, said secondary conductive film being situated adjacent to and insulated from said primary conductive film, said primary and secondary conductive films being disposed on opposite sides of a longitudinal axis, said secondary conductive film having first and second terminal portions extending at an angle therefrom;

said dielectric membrane being folded along at least one fold line parallel to said longitudinal axis so that said primary and secondary conductive films overlie each other; and said dielectric membrane and said conductive films being wound about a central axis perpendicular to said longitudinal axis in the form of a spiral, such that said primary and secondary windings are situated in the same spiral plane, to provide a multiturn, barrel-wound transformer winding structure having said primary and secondary terminal portions extending outwardly therefrom.

2. The improvement recited in claim 1 wherein:

said transformer includes a magnetic core having a post extending along said longitudinal axis, said winding structure surrounding said post.

3. The improvement recited in claim 1 wherein:

said primary winding conductive film and said secondary winding conductive film are disposed on the same major surface of said dielectric membrane.

4. The improvement recited in claim 3 wherein:

said primary winding conductive film and said secondary winding conductive film are aligned.

5. The improvement recited in claim 1 wherein:

said primary winding is configured to have at least two winding portions, said primary winding being folded such that the winding portions are aligned.

6. The improvement recited in claim 1 wherein:

said primary winding conductive film includes a first fold substantially parallel to the length of the winding and a second fold substantially perpendicular to the length of the winding.

7. The improvement recited in claim 1 wherein:

said primary winding conductive film and said secondary winding conductive film are disposed on opposed major surfaces of said dielectric membrane.

8. The improvement recited in claim 7 wherein:

said primary winding conductive film and said secondary winding conductive film are aligned.

9. The improvement recited in claim 1 wherein:

said first and second external terminal portions of said primary winding conductive film extend substantially perpendicular to the length of said primary winding conductive film.

10. The improvement recited in claim 9 wherein:

the spacing lengthwise of said primary winding conductive film between said primary winding terminal portions, the combined thickness of said dielectric membrane and said conductive films and the diameter of said spiral are related such that said first and second primary winding terminal portions are aligned.

11. The improvement recited in claim 10 wherein:

said first and second terminal portions of said secondary winding conductive film extend substantially perpendicular to the length of said secondary winding conductive film.

12. The improvement recited in claim 11 wherein:

the spacing lengthwise of said secondary winding conductive film between said secondary winding terminal portions, the combined thickness of said dielectric membrane and said conductive films and the diameter of said spiral are related such that said first and second secondary winding terminal portions are aligned.

13. The improvement recited in claim 12 wherein:

said secondary winding terminal portions and said primary winding terminal portions are disposed at 180° with respect to each other on said spiral.

14. The improvement recited in claim 1 wherein:

said first and second terminal portions of said secondary winding conductive film extend substantially perpendicular to the length of said secondary winding conductive film.

15. The improvement recited in claim 14 wherein:

the spacing lengthwise of said secondary winding conductive film between said secondary winding terminal portions, the combined thickness of said dielectric membrane and said conductive films and the diameter of said spiral are related such that said first and second secondary winding terminal portions are aligned.

16. The improvement recited in claim 15 wherein:

said secondary winding terminal portions and said primary winding terminal portions are disposed at 180° with respect to each other on said spiral.

17. The improvement recited in claim 1 wherein:

said secondary winding conductive film has a generally rectangular configuration and is folded upon itself substantially perpendicular to the direction of winding to provide two parallel connected secondary windings.

18. The improvement recited in claim 17 wherein:

the sides of said rectangular configuration comprise said terminal portions of said secondary winding.

19. The improvement recited in claim 18 wherein:

said generally rectangular configuration is substantially trapezoidal with its bases disposed parallel to the direction of winding of said membrane whereby after winding of said membrane into said spiral, each turn of said secondary winding conductive film is substantially one full turn long and said terminal portions of said secondary winding conductive film are spaced apart along the length of said secondary conductive film by substantially an integral number of turns whereby they overlap.

20. The improvement recited in claim 1 wherein:

said secondary winding comprises a tapped winding having a tap terminal portion.

21. The improvement recited in claim 20 wherein:

said terminal portions of said secondary conductive film extend substantially perpendicular to the length of said secondary conductive film.

22. The improvement recited in claim 21 wherein:

said tap terminal portion is a center tap.

23. The improvement recited in claim 22 wherein:

said secondary winding conductive film has a generally figure 8 configuration and is folded upon itself substantially perpendicular to the direction of winding to provide two parallel connected secondary windings.

24. The improvement recited in claim 23 wherein:

the vertical center line of said numerical 8 is oriented substantially parallel to the direction of winding said membrane about said axis.

25. The improvement recited in claim 24 wherein:

the top, bottom and crossbars of said figure 8 comprise said terminal portions of said secondary winding.

26. The improvement recited in claim 25 wherein:

said figure 8 has a substantially trapezoidal configuration whereby after winding into said spiral, each turn of said secondary winding conductive film is at least substantially one full turn long and said terminal portions of said secondary winding conductive film are spaced apart along the length of said film by substantially an integral number of turns whereby they overlap.

27. The improvement recited in claim 26 wherein:

said secondary winding conductive film has a generally double numeral 8 configuration and is folded upon itself substantially perpendicular to the direction of rolling to provide four parallel connected secondary windings.

28. The improvement recited in claim 27 wherein:

said double numeral 8 has a substantially trapezoidal configuration whereby after winding into a spiral each turn of said secondary winding conductive film is substantially one full long and said external terminal portions of said secondary winding conductive film are spaced apart along the length of said film by substantially an integral number of turns whereby they overlap.

29. The improvement recited in claim 27 wherein:

said secondary winding conductive film includes first, second and third external terminal portions which extend substantially perpendicular to the length of said secondary winding conductive film.

30. The improvement recited in claim 29 wherein:

the spacing, along the length of said secondary winding conductive film, between said secondary winding terminal portions, the combined thickness of said dielectric membrane and said conductive films and the diameter of said spiral are related to a manner which places said first, second and third secondary winding terminal portions in an aligned or overlapping relation.

* * * * *